US010569544B2

(12) United States Patent
McClelland

(10) Patent No.: US 10,569,544 B2
(45) Date of Patent: Feb. 25, 2020

(54) MULTI-LAYERED NOZZLE FLUID EJECTION DEVICE

(71) Applicant: HEWLETT-PACKARD DEVELOPMENT COMPANY, L.P., Fort Collins, CO (US)

(72) Inventor: Sean P McClelland, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/082,317

(22) PCT Filed: Jul. 12, 2016

(86) PCT No.: PCT/US2016/041928

§ 371 (c)(1),
(2) Date: Sep. 5, 2018

(87) PCT Pub. No.: WO2018/013092

PCT Pub. Date: Jan. 18, 2018

(65) Prior Publication Data

US 2019/0126617 A1 May 2, 2019

(51) Int. Cl.
*B41J 2/14* (2006.01)

(52) U.S. Cl.
CPC ..... *B41J 2/1433* (2013.01); *B41J 2/1404* (2013.01); *B41J 2002/14403* (2013.01)

(58) Field of Classification Search
CPC ..... B41J 2/1433; B41J 2/1404; B41J 2002/14403
See application file for complete search history.

(56) References Cited

U.S. PATENT DOCUMENTS

| | | | | |
|---|---|---|---|---|
| 6,074,043 | A | 6/2000 | Ahn | |
| 7,568,785 | B2 | 8/2009 | Deguchi et al. | |
| 8,303,087 | B2 | 11/2012 | Linliu | |
| 8,388,113 | B2 | 3/2013 | Park et al. | |
| 9,168,747 | B2 | 10/2015 | Redding et al. | |
| 2003/0142170 | A1* | 7/2003 | Haluzak | B41J 2/1404 347/54 |
| 2003/0184616 | A1 | 10/2003 | Yang et al. | |

(Continued)

FOREIGN PATENT DOCUMENTS

| | | |
|---|---|---|
| CN | 1907710 | 2/2007 |
| CN | 101444993 | 6/2009 |

(Continued)

OTHER PUBLICATIONS

Lindemann, T., et al., Thermal Bubble Jet Printhead with Integrated Nozzle Plate, Jul. 14, 2004.

*Primary Examiner* — Sharon A. Polk
(74) *Attorney, Agent, or Firm* — HP Inc. Patent Department

(57) ABSTRACT

According to examples, a multi-layered nozzle fluid ejection device may include a first nozzle layer including a first nozzle layer thickness and a first nozzle layer orifice, and a second nozzle layer including a second nozzle layer thickness and a second nozzle layer orifice. The first nozzle layer orifice may include a first nozzle layer orifice dimension that is different than a second nozzle layer orifice dimension of the second nozzle layer orifice.

19 Claims, 4 Drawing Sheets

(56) References Cited

U.S. PATENT DOCUMENTS

| | | | | |
|---|---|---|---|---|
| 2003/0207477 | A1 | 11/2003 | Dodd et al. | |
| 2008/0062235 | A1* | 3/2008 | Nielsen | B01L 3/0268 347/109 |
| 2014/0285576 | A1 | 9/2014 | Rivas et al. | |

FOREIGN PATENT DOCUMENTS

| | | | |
|---|---|---|---|
| EP | 707961 | A2 | 4/1996 |
| JP | 2008149526 | A | 7/2008 |
| JP | 2011005690 | A | 1/2011 |

* cited by examiner

MULTI-LAYERED NOZZLE FLUID EJECTION DEVICE

BACKGROUND INFORMATION

In some printing systems, a fluid ejection device is a component that ejects and/or deposits printing material onto a substrate or media during printing. An example of a substrate includes paper. The printing material may be ejected onto the substrate in the form of drops to generate a printed substrate.

BRIEF DESCRIPTION OF DRAWINGS

Features of the present disclosure are illustrated by way of examples shown in the following figures. In the following figures, like numerals indicate like elements, in which.

DETAILED DESCRIPTION

Figure 1A:
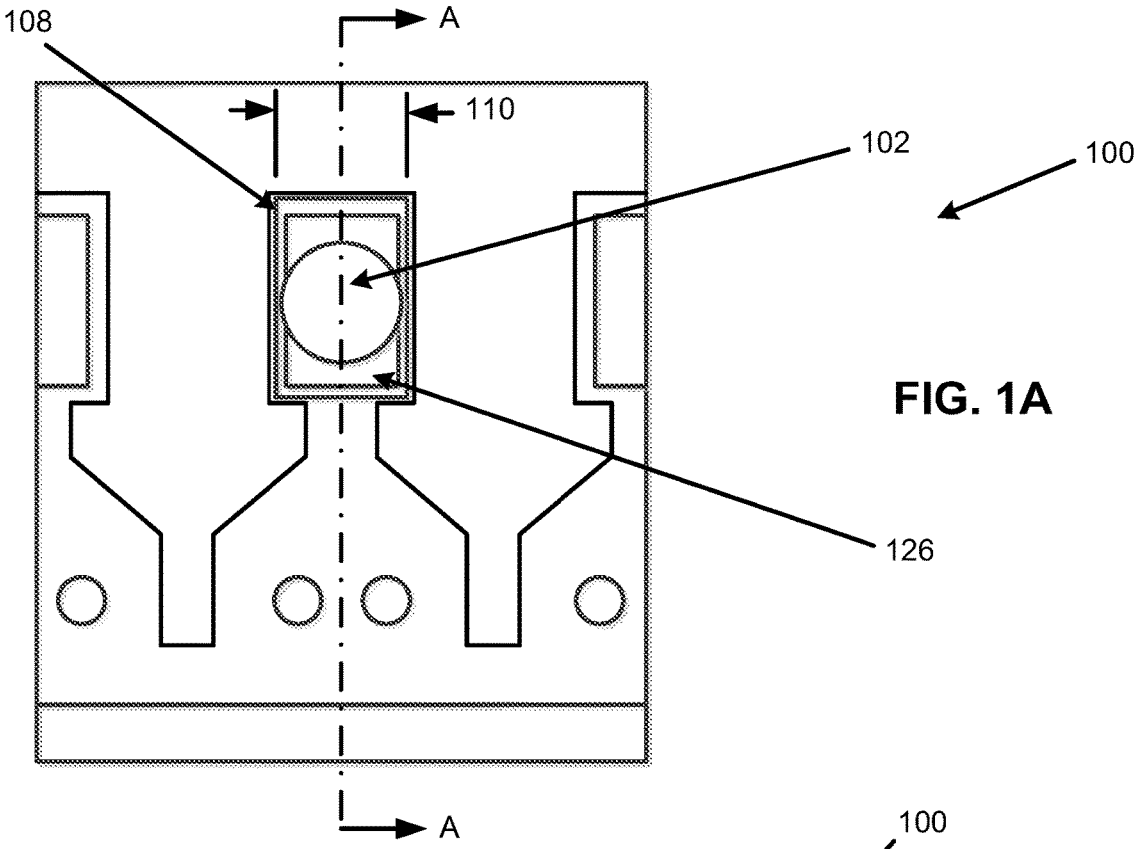
FIG. 1A illustrates a top view of a multi-layered nozzle fluid ejection device, according to an example of the present disclosure.

For simplicity and illustrative purposes, the present disclosure is described by referring mainly to examples thereof. In the following description, details are set forth in order to provide an understanding of the present disclosure. It will be readily apparent however, that the present disclosure may be practiced without limitation to these details. In other instances, methods and structures apparent to one of ordinary skill in the art have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

According to examples of the present disclosure, a multi-layered nozzle fluid ejection device is disclosed herein. The fluid ejection device disclosed herein may be used with an inkjet printer, and other such printers. The fluid ejection device disclosed herein may provide for the ejection of printing materials of different viscosities. Generally, printing material, as described herein may comprise consumable fluids as well as other consumable materials. Printing material may comprise ink, toner, fluids, powders, colorants, varnishes, finishes, gloss enhancers, binders, and/or other such materials that may be utilized in a printing process. For example, the fluid ejection device disclosed herein may provide for the ejection of printing materials that include a relatively low viscosity of approximately 1 centipoise (cP), to printing materials that include a relatively high viscosity of greater than approximately 1 cP (e.g., 6 cP).

With respect to printing material viscosity, viscosities of printing materials are continually being increased in an effort to attain new products with increased durability, gamut, optical density, and weather resistance. This increase in printing material viscosity may directly affect the resistance in a nozzle, which in turn impacts the ability for the printing material to be ejected. The variables impacting nozzle resistance include nozzle orifice (also referred to as bore) diameter for a circular nozzle, nozzle layer thickness, and printing material viscosity. High viscosity printing materials may be jetted with high drop weights (i.e., based on relatively large nozzle orifice diameters) and a minimum nozzle layer thickness that is needed for nozzle level robustness to cracking. In this regard, the multi-layered nozzle fluid ejection device disclosed herein may include a plurality of nozzle layers. By including a plurality of nozzle layers, the mechanical robustness of the nozzle layers may be decoupled from the drop ejection capability of the fluid ejection device disclosed herein for a printing material of a specified viscosity. Thus, high viscosity printing materials may be ejected from the fluid ejection device disclosed herein without the drawback of a fragile nozzle layer.

With respect to the plurality of nozzle layers, for the multi-layered nozzle fluid ejection device disclosed herein, the nozzle layers may be laminated or joined by using other such techniques. Each of the nozzle layers may be formed by imaging or other such techniques. For example, each of the nozzle layers may be imaged with a different photo mask.

According to an example, the multi-layered nozzle fluid ejection device disclosed herein may include a plurality of nozzle layers that are laminated, and the plurality of nozzle layers may be imaged with different photo masks. For example, the fluid ejection device disclosed herein may include two nozzle layers that are laminated. Alternatively, the fluid ejection device disclosed herein may include greater than two nozzle layers that are laminated. Each of the nozzle layers may be imaged with a different photo mask. Alternatively, for a multi-layered nozzle fluid ejection device that includes greater than two nozzle layers, at least two of the nozzle layers may be imaged with a different photo mask.

For a multi-layered nozzle fluid ejection device that includes two nozzle layers, the first nozzle layer may be applied onto the region directly over a firing chamber. The applied first nozzle layer may then be patterned. The pattern may be the same size as the firing chamber down to the diameter of the nozzle orifice entrance in the second nozzle layer. Alternatively, the pattern may be the larger than as the firing chamber down to the diameter of the nozzle orifice entrance in the second nozzle layer. The second nozzle layer may be applied and patterned with a nozzle orifice mask.

By using the two nozzle layers for the multi-layered nozzle fluid ejection device disclosed herein, the nozzle layer everywhere except in the firing chamber may include one thickness, with the region directly over a fluid ejector of the fluid ejection device disclosed herein including a second thickness. For example, if the first and second nozzle layers each include a 9 μm thickness, as disclosed herein, the region over the printing material slot may be approximately four times stronger, while maintaining the same nozzle resistance over the firing chamber of the fluid ejection device disclosed herein.

For the multi-layered nozzle fluid ejection device disclosed herein, the first and second nozzle layers may each include the same or different thicknesses. For example, for a nozzle that includes a total 20 μm thickness, the first nozzle layer may be thicker (e.g., 14 μm) compared to the second nozzle layer (e.g., 6 μm). Thus, the relatively thin orifice of the second nozzle layer may provide for ejection of higher viscosity printing materials, or lower viscosity solutions at relatively lower drop weights.

Some examples described herein may be implemented in printing systems in which a printing material may be distributed on a build layer of build material such that these examples may perform a layer-wise additive manufacturing process. Examples of such layer-wise additive manufacturing printing systems may be referred to as three-dimensional printers. In such examples, fluid ejection devices as described herein may selectively distribute printing materials on a layer of powder-based build material to facilitate fusion of portions of such build material. As will be appreciated, each layer may correspond to a cross-section of a three-dimensional object to be formed. Sequentially layering and fusing layers of build material on top of previous layers may facilitate generation of the three-dimensional object. In examples described herein, a build material may include a powder-based build material, where powder-based build material may comprise wet and/or dry powder-based materials, particulate materials, and/or granular materials. For three-dimensional printers, the ejected fluids may be referred to as agents that increase energy absorption or decrease energy absorption of the media upon which the fluid is distributed. For two-dimensional printers, bonding agent, glosses, etc., may be applied as disclosed herein.

Figure 1B:
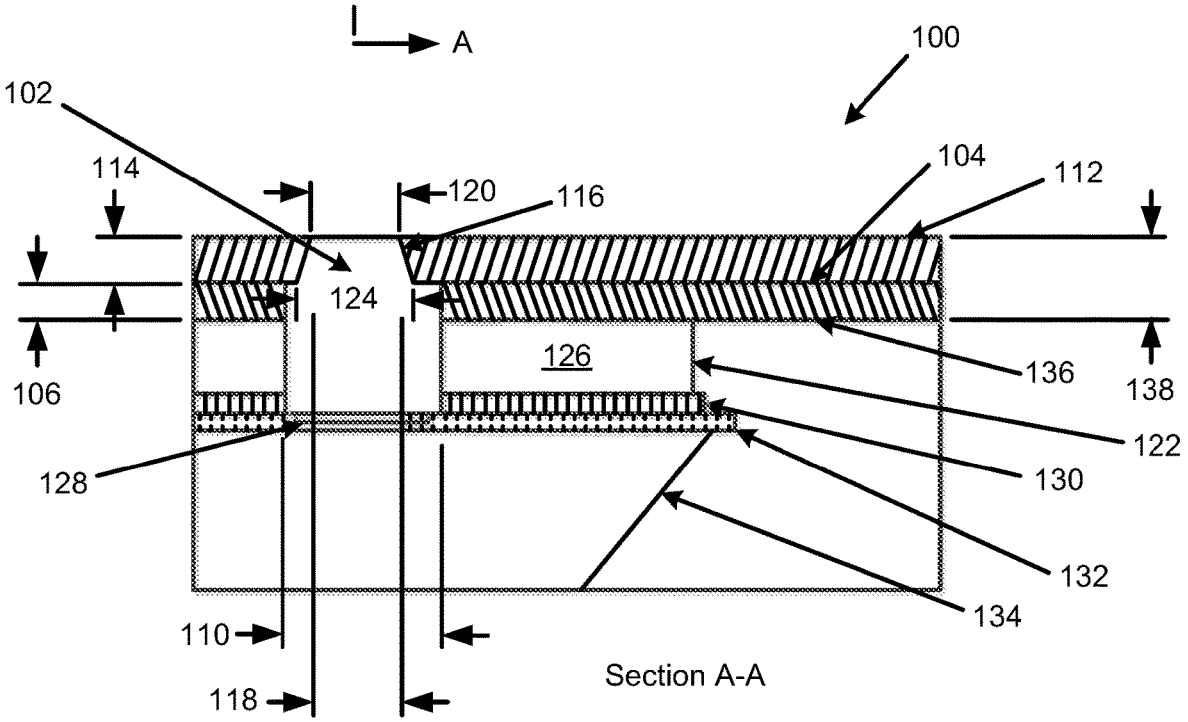
FIG. 1B illustrates a cross-sectional view of the multi-layered nozzle fluid ejection device of FIG. 1A, taken along section A-A in FIG. 1A, according to an example of the present disclosure.

FIG. 1A illustrates a top view of a multi-layered nozzle fluid ejection device 100 (hereinafter "fluid ejection device 100"), according to an example of the present disclosure. FIG. 1B illustrates a cross-sectional view of the fluid ejection device 100 taken along section A-A in FIG. 1A, according to an example of the present disclosure.

Referring to FIGS. 1A and 1B, the fluid ejection device 100 may include a nozzle 102 including a first nozzle layer 104 including a first nozzle layer thickness 106. The first nozzle layer 104 may further include a first nozzle layer orifice 108 including a first nozzle layer orifice dimension 110. For a circular first nozzle layer orifice 108 (not shown), the first nozzle layer orifice dimension 110 may include a first nozzle layer orifice diameter. Alternatively, as shown in FIG. 1A, the first nozzle layer orifice 108 may be shaped in a rectangular configuration. For the rectangular first nozzle layer orifice 108, the first nozzle layer orifice dimension 110 may include a width of the first nozzle layer orifice 108. Alternatively, the first nozzle layer orifice 108 may be of any other configuration as will be appreciated in view of this disclosure. For example, the first nozzle layer orifice 108 may include an oval, square, or another type of shape as will be appreciated in view of this disclosure.

The fluid ejection device 100 may further include a second nozzle layer 112 including a second nozzle layer thickness 114. The second nozzle layer 112 may further include a second nozzle layer orifice 116 including a second nozzle layer orifice dimension 118. For a circular second nozzle layer orifice 116, the second nozzle layer orifice dimension 118 may include a second nozzle layer orifice diameter. Alternatively, the second nozzle layer orifice 116 may be shaped, for example, in an oval or another type of configuration as will be appreciated in view of this disclosure.

As shown in FIG. 1B, the second nozzle layer orifice dimension 118 is generally designated so that it may include the dimension 120 at the outermost surface of the second nozzle layer 112 relative to an ejection chamber 122. Alternatively, the second nozzle layer orifice dimension 118 may include the dimension 124 at the innermost surface of the second nozzle layer 112 relative to the ejection chamber 122. In either case, any of the dimensions of the second nozzle layer orifice 116 may be different compared to the first nozzle layer orifice dimension 110. In this regard, the second nozzle layer orifice 116 may include a tapered cross-section between the surfaces that designate the dimension 120 and the dimension 124.

The ejection chamber 122 may supply printing material 126 to be ejected from the nozzle 102. The ejection chamber 122 may span a portion of the first nozzle layer 104 and the second nozzle layer 112 as shown in FIG. 1B. The portion of the first nozzle layer 104 and the second nozzle layer 112 that extends beyond the ejection chamber 122 may be designated as an unsupported span as described in further detail herein.

The fluid ejection device 100 may further include a fluid ejector 128 to heat the printing material 126 to eject the printing material 126 from the nozzle 102. The fluid ejector 128 may include a heating element that includes a resistor, and other such devices (e.g., piezoelectric membrane based devices) to eject the printing material 126 from the nozzle 102 as will be appreciated in view of this disclosure.

The first nozzle layer 104 may be disposed between the second nozzle layer 112 and the ejection chamber 122. Further, the first nozzle layer orifice dimension 110 may be greater than the second nozzle layer orifice dimension 118 (which, as disclosed herein, may include any dimension of the second nozzle layer orifice 116 between the surfaces that designate the dimension 120 and the dimension 124). For example, as shown in FIG. 1B, the first nozzle layer orifice dimension 110 may be greater than the dimension 120 at the outermost surface of the second nozzle layer 112 relative to the ejection chamber 122, the dimension 124 at the innermost surface of the second nozzle layer 112 relative to the ejection chamber 122, or any dimension between the dimension 120 and the dimension 124. That is, the first nozzle layer orifice dimension 110 may be greater than any of the dimensions of the second nozzle layer orifice 116 along the tapered section of the second nozzle layer orifice 116 as shown in FIG. 1B.

The fluid ejection device 100 may further include other features such as a primer layer 130 for photoresist (e.g., SU-8) adhesion, a plurality of thin film layers 132 forming the fluid ejector 128 as well as electrical routing and reliability specifications, and a Silicon substrate layer 134.

Figure 2A:
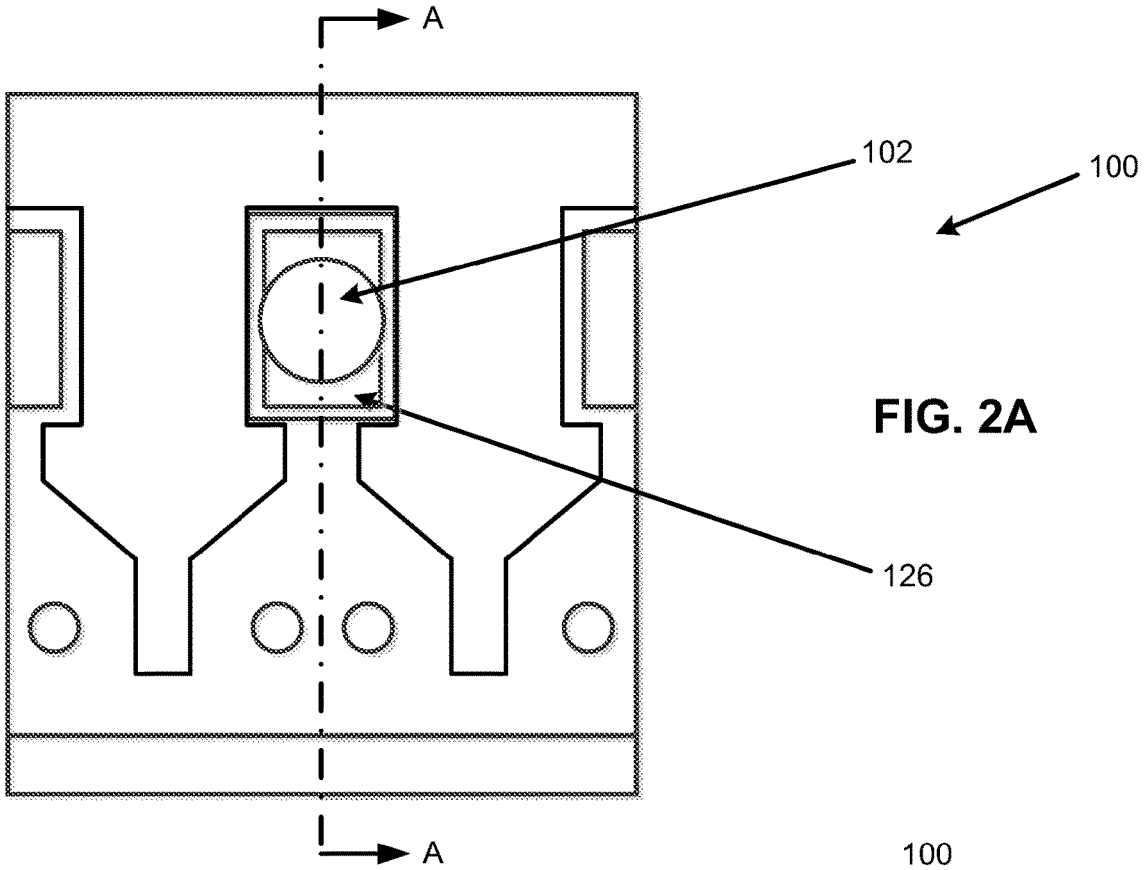
FIG. 2A illustrates a top view of a multi-layered nozzle fluid ejection device, according to an example of the present disclosure.
Figure 2B:
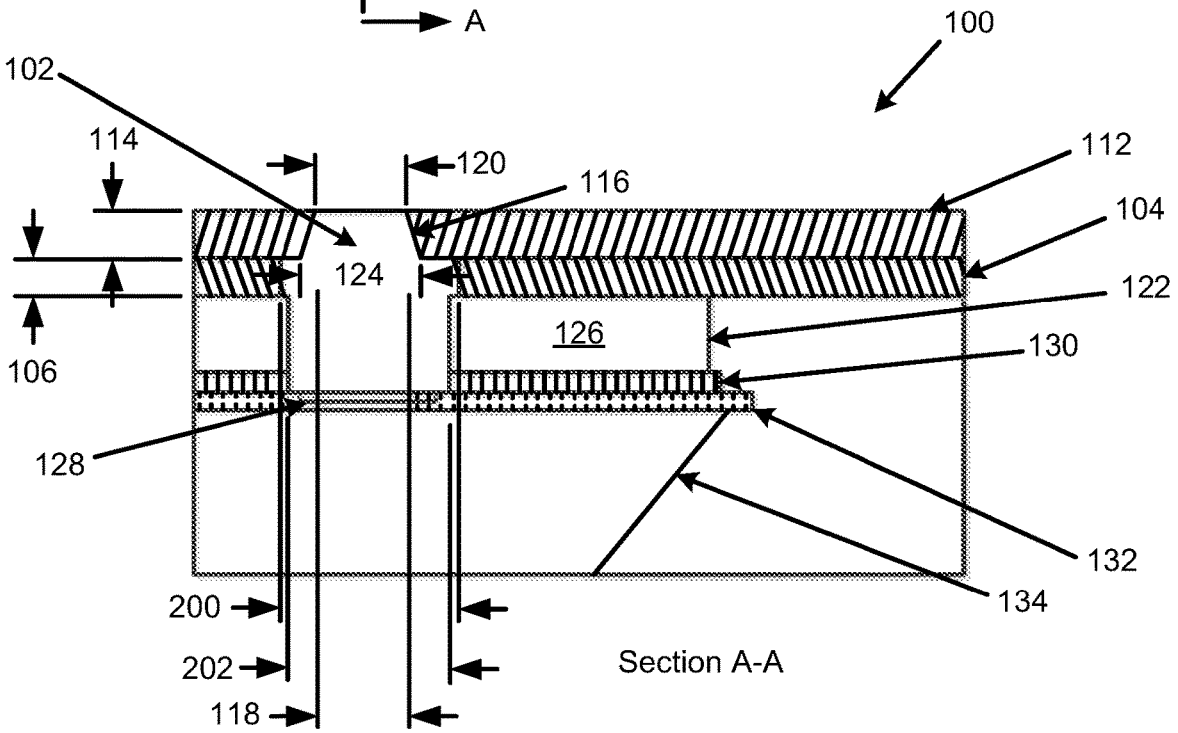
FIG. 2B illustrates a cross-sectional view of the multi-layered nozzle fluid ejection device of FIG. 2A taken along section A-A in FIG. 2A, according to an example of the present disclosure.

FIG. 2A illustrates a top view of the fluid ejection device 100, according to an example of the present disclosure. FIG. 2B illustrates a cross-sectional view of the fluid ejection device 100 taken along section A-A in FIG. 2A, according to an example of the present disclosure.

Referring to FIGS. 2A and 2B, compared to the fluid ejection device configuration of FIGS. 1A and 1B, for the fluid ejection device configuration of FIGS. 2A and 2B, a first nozzle layer orifice dimension 200 may be greater than a corresponding opening dimension 202 of the ejection chamber 122. For example, for the fluid ejection device configuration of FIGS. 1A and 1B, the first nozzle layer orifice dimension 110 is approximately equal to a corresponding opening dimension of the ejection chamber 122. However, as shown in FIGS. 2A and 2B, the first nozzle layer orifice dimension 200 is greater than the corresponding opening dimension 202 of the ejection chamber 122. In this regard, the relatively larger first nozzle layer orifice dimension 200 provides for increased refill capabilities of the printing material 126 from the ejection chamber 122. For example, the relatively larger first nozzle layer orifice dimension 200 provides for increased speed of refill of the printing material 126 from the ejection chamber 122. The relatively larger first nozzle layer orifice dimension 200 provides for a reduction in the capillary radius of the printing material 126, where the reduced thickness second nozzle layer 112 may pull the meniscus of the printing material 126 into the firing chamber, and increase the capillary radius of the printing material 126.

Figure 3:
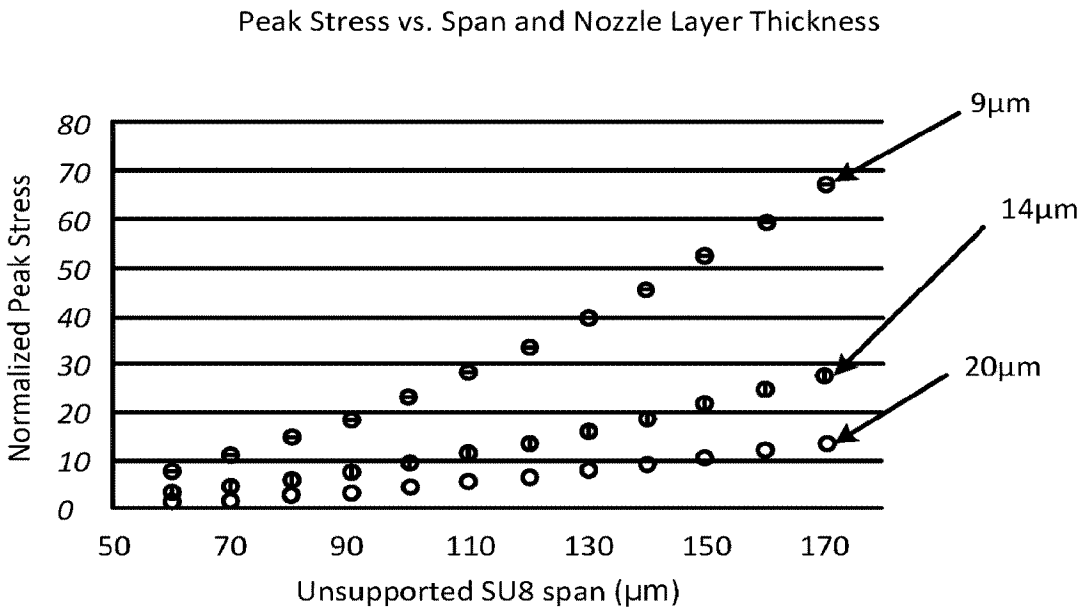
FIG. 3 illustrates a graph of peak stress versus span and nozzle layer thickness, according to an example of the present disclosure.
Figure 4:
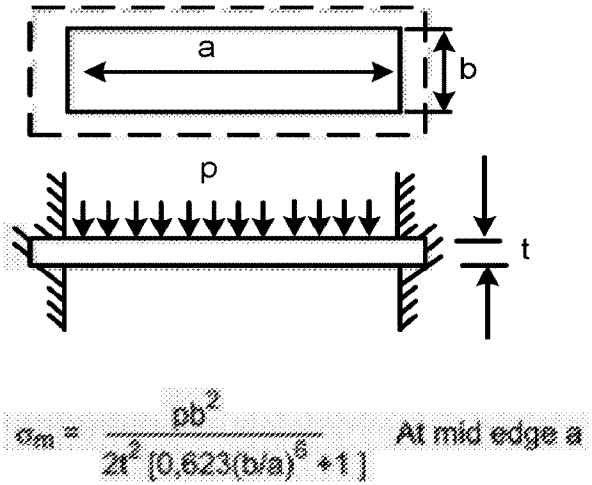
FIG. 4 illustrates stress determination for a beam, according to an example of the present disclosure.
Figures 5A, 5B, 5C:
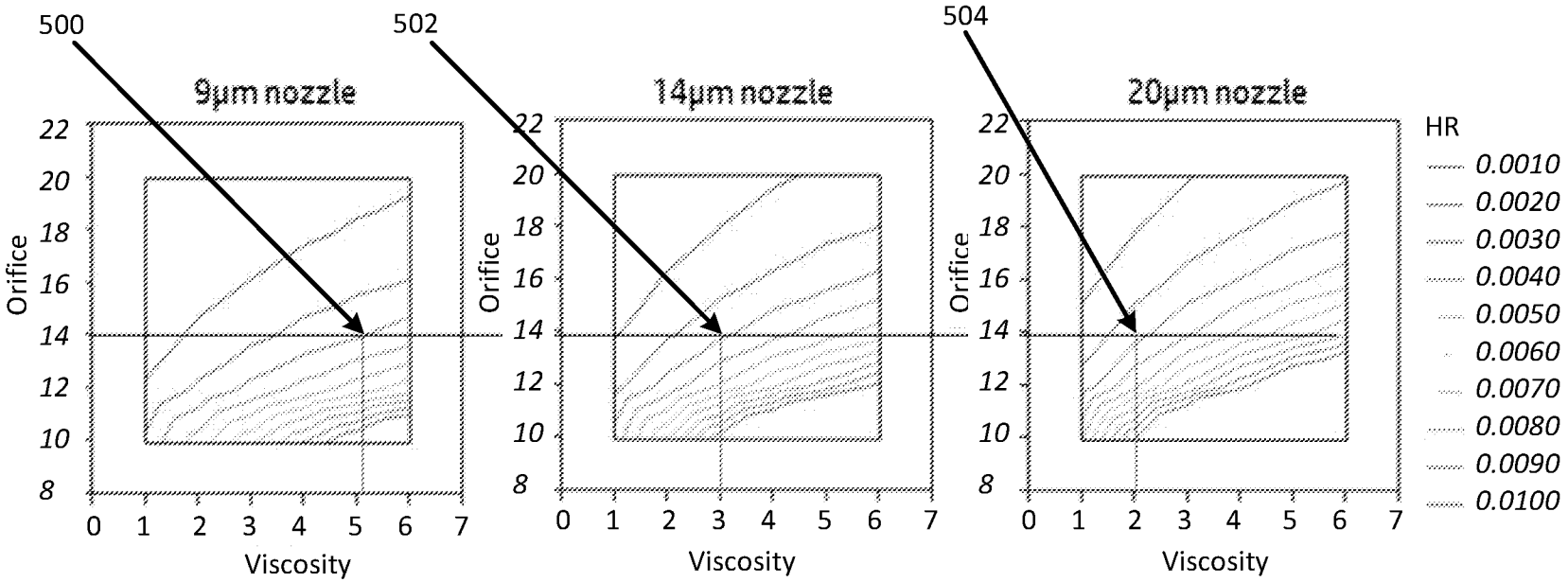
FIGS. 5A-5C respectively illustrate contour plots that show nozzle resistance as a function of viscosity, nozzle orifice diameter, and nozzle layer thickness, according to an example of the present disclosure.

FIG. 3 illustrates a graph of peak stress versus span and nozzle layer thickness, according to an example of the present disclosure. FIG. 4 illustrates stress determination for a beam, according to an example of the present disclosure. FIGS. 5A-5C respectively illustrate contour plots that show nozzle resistance as a function of viscosity, orifice diameter, and nozzle layer thickness, according to an example of the present disclosure.

Referring again to FIGS. 1A, 1B, 3, 4, and 5A-5C, the nozzle 102 may include a total nozzle layer thickness. The total nozzle layer thickness may include the first nozzle layer thickness 106, and the second nozzle layer thickness 114 that corresponds to a specified viscosity of the printing material 126 and a specified hydraulic resistance associated with the second nozzle layer 112. In this regard, the total nozzle layer thickness may be based on a stress associated with an unsupported span 136 of the first nozzle layer 104 and the second nozzle layer 112. The unsupported span 136 of the first nozzle layer 104 and the second nozzle layer 112 may represent a portion of the first nozzle layer 104 and the second nozzle layer 112 to the right of the ejection chamber 122 in the orientation of FIG. 1B.

For example, as shown in FIG. 4, for a beam, the stress may be determined as a function of the width b, the length a, the force p, and the thickness t as follows:

$$\sigma_m = \frac{pb^2}{2y^2\left[0.623\left(\frac{b}{a}\right)^6 + 1\right]} \qquad \text{Equation (1)}$$

Based on Equation (1), the peak stress of the unsupported span 136 of the first nozzle layer 104 and the second nozzle layer 112 may be determined as a function of a total nozzle layer thickness 138 (see FIG. 1B). The graph of FIG. 3 illustrates the relationship between the total nozzle layer thickness 138 and peak stress. For example, the graph of FIG. 3 may be used to evaluate the relationship between the total nozzle layer thickness 138 and peak stress based on the assumption that the nozzle layer thickness plots represent the total nozzle layer thickness 138 that includes the first nozzle layer thickness 106 and the second nozzle layer thickness 114.

Referring to FIG. 3, the peak stress indicates that at approximately 14 μm thickness, the unsupported span 136 of approximately 110 μm includes an approximately 11 $N/m^2$ peak stress with a normalized load. Similarly, the peak stress for the unsupported span 136 including an approximately 9 μm thickness, or an approximately 20 μm thickness may be determined. The values of peak stress may be used to determine a maximum stress encountered by the unsupported span 136. For example, assuming that at a 20 μm total nozzle layer thickness of the first nozzle layer 104 and the second nozzle layer 112, and at an unsupported span 136 of approximately 110 μm, the peak stress is acceptable, this 20 μm total nozzle layer thickness may be further used to determine the first nozzle layer thickness 106 as disclosed herein with respect to FIGS. 5A-5C.

Referring to FIGS. 5A-5C, the contour plots show nozzle resistance as a function of viscosity, nozzle orifice diameter, and nozzle layer thickness. The points marked at 500, 502, and 504 represent the same resistance contour line at a given orifice dimension showing how decreased nozzle layer thickness will enable less nozzle resistance for relatively higher viscosity solutions. The nozzle hydraulic resistance may be determined as follows:

$$\text{Hydraulic Resistance} = \frac{8\mu l}{\pi r^4} \qquad \text{Equation (2)}$$

For Equation (2), l may represent the nozzle layer thickness, and r may represent the nozzle orifice diameter for a circular nozzle orifice.

Referring to FIGS. 5A-5C, assuming that the fluid ejection device 100 is to use a printing material 126 of a 5 cP specified viscosity and includes a specified hydraulic resistance of 0.0030, the fluid ejection device 100 may be configured to include a second nozzle layer thickness 114 of 9 μm, and a second nozzle orifice diameter of 14 μm (i.e., where the second nozzle orifice diameter of 14 μm corresponds to the dimension 120). Further, as disclosed herein with respect to FIGS. 3 and 4, assuming that at a 20 μm total nozzle layer thickness of the first nozzle layer 104 and the second nozzle layer 112, and at an unsupported span 136 of approximately 110 μm, the peak stress is acceptable, this 20 μm total nozzle layer thickness may be further used to determine the first nozzle layer thickness 106. For example, as disclosed herein with respect to FIGS. 5A-5C, if the second nozzle layer thickness 114 is determined to be 9 μm for the 5 cP specified viscosity and the specified hydraulic resistance of 0.0030, the first nozzle layer thickness 106 may be determined to be 11 μm (i.e., 20 μm total nozzle layer thickness minus the second nozzle layer thickness 114 of 9 μm).

In this manner, as disclosed herein with respect to FIGS. 3-5C, the second nozzle layer thickness 114 may be determined as a function of the specified viscosity and the specified hydraulic resistance, the total nozzle layer thickness 138 may be determined based on an acceptable peak stress associated with the unsupported span 136 of the first nozzle layer 104 and the second nozzle layer 112, and the first nozzle layer thickness 106 may be determined by subtracting the second nozzle layer thickness 114 from the total nozzle layer thickness 138. Thus, based on the viscosity of the printing material 126 and the specified hydraulic resistance, the second nozzle layer thickness 114 may be determined to be less than, equal to, or greater than the first nozzle layer thickness 106. For example, the second nozzle layer thickness 114 may be approximately 9 μm. According to another example, the second nozzle layer thickness 114 may be less than approximately 9 μm.

Further, with respect to FIGS. 5A-5C, by reducing the second nozzle layer thickness 114 from 20 μm, to 14 μm, to 9 μm, for a second nozzle orifice diameter of 14 μm (i.e., where the second nozzle orifice diameter of 14 μm corresponds to the dimension 120), the viscosity of the printing material 126 may be similarly increased from 2 cP, to 3 cP, to 5 cP, respectively. In this manner, the viscosity of the printing material 126 may be further increased to greater than 5 cP by further reducing the second nozzle layer thickness 114.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. A multi-layered nozzle fluid ejection device comprising:

a nozzle including a first nozzle layer including a first nozzle layer thickness and a first nozzle layer orifice dimension, and a second nozzle layer including a second nozzle layer thickness and a second nozzle layer orifice diameter, wherein the first nozzle layer orifice dimension is different than the second nozzle layer orifice diameter;

an ejection chamber to supply printing material to be ejected from the nozzle; and a fluid ejector to eject the printing material from the nozzle;

wherein the first nozzle layer orifice dimension is greater than a corresponding opening dimension of the ejection chamber.

2. The multi-layered nozzle fluid ejection device according to claim 1, wherein the first nozzle layer is disposed between the second nozzle layer and the ejection chamber, and the first nozzle layer orifice dimension is greater than the second nozzle layer orifice diameter.

3. The multi-layered nozzle fluid ejection device according to claim 1, wherein the second nozzle layer includes a tapered cross-section, and the second nozzle layer orifice diameter is disposed at an outermost surface of the second nozzle layer relative to the ejection chamber.

4. The multi-layered nozzle fluid ejection device according to claim 1, wherein the second nozzle layer includes a tapered cross-section, and the second nozzle layer orifice diameter is disposed at an innermost surface of the second nozzle layer relative to the ejection chamber.

5. The multi-layered nozzle fluid ejection device according to claim 1, wherein the nozzle includes a total nozzle layer thickness, and the total nozzle layer thickness includes the first nozzle layer thickness, and the second nozzle layer thickness that corresponds to a specified viscosity of the printing material and a specified hydraulic resistance for the second nozzle layer.

6. The multi-layered nozzle fluid ejection device according to claim 5, wherein the total nozzle layer thickness is based on a stress associated with an unsupported span of the first nozzle layer and the second nozzle layer.

7. The multi-layered nozzle fluid ejection device according to claim 1, wherein the second nozzle layer thickness is approximately 9 μm.

8. The multi-layered nozzle fluid ejection device according to claim 1, wherein the second nozzle layer thickness is less than approximately 9 μm.

9. The multi-layered nozzle fluid ejection device according to claim 1, wherein the fluid ejector is a resistor.

10. A multi-layered nozzle fluid ejection device comprising:

a nozzle including a first nozzle layer including a first nozzle layer thickness and a first nozzle layer orifice, and a second nozzle layer including a second nozzle layer thickness and a second nozzle layer orifice, wherein the first nozzle layer orifice includes a first nozzle layer orifice dimension that is different than a second nozzle layer orifice dimension of the second nozzle layer orifice, and the first nozzle layer orifice dimension and the second nozzle layer orifice dimension are respectively disposed generally orthogonal to the first nozzle layer thickness and the second nozzle layer thickness; and an ejection chamber to supply printing material to be ejected from the nozzle;

wherein one of the first and second nozzle layer orifices includes a cross section that tapers in a direction parallel to the first and second nozzle layer thicknesses, and wherein the other of the first and second nozzle layer orifices includes a cross section that has a constant diameter in the direction.

11. The multi-layered nozzle fluid ejection device according to claim 10, wherein the second nozzle layer orifice dimension includes a second nozzle layer orifice diameter.

12. The multi-layered nozzle fluid ejection device according to claim 11, wherein the first nozzle layer is disposed between the second nozzle layer and the ejection chamber, and the first nozzle layer orifice dimension is greater than the second nozzle layer orifice diameter.

13. A multi-layered nozzle fluid ejection device comprising:

a first nozzle layer including a first nozzle layer thickness and a first nozzle layer orifice;

a second nozzle layer including a second nozzle layer thickness and a second nozzle layer orifice, wherein the first nozzle layer orifice includes a first nozzle layer orifice dimension that is different than a second nozzle layer orifice dimension of the second nozzle layer orifice, the second nozzle layer thickness is based on a specified viscosity of printing material that is to be used with the multi-layered nozzle fluid ejection device and a specified hydraulic resistance for the second nozzle layer, and the first nozzle layer thickness is based on a stress to be supported by a portion of the first nozzle layer and a portion of the second nozzle layer; and an ejection chamber to supply the printing material to be ejected from the first nozzle layer orifice and the second nozzle layer orifice.

14. The multi-layered nozzle fluid ejection device according to claim 13, wherein the first nozzle layer orifice dimension is greater than a corresponding opening dimension of the ejection chamber.

15. A multi-layered nozzle fluid ejection device comprising:

a nozzle including:

a first nozzle layer including a first nozzle layer thickness and a first nozzle layer orifice dimension, and a second nozzle layer including a second nozzle layer thickness and a second nozzle layer orifice diameter, wherein the first nozzle layer orifice dimension is different than the second nozzle layer orifice diameter, and wherein the second nozzle layer thickness corresponds to a specified viscosity of the printing material and a specified hydraulic resistance for the second nozzle layer;

an ejection chamber to supply printing material to be ejected from the nozzle; and a fluid ejector to eject the printing material from the nozzle.

16. The multi-layered nozzle fluid ejection device according to claim 15, wherein a total nozzle layer thickness includes the first nozzle layer thickness and the second nozzle layer thickness, and wherein the total nozzle layer thickness is based on a stress associated with an unsupported span of the first nozzle layer and the second nozzle layer.

17. The multi-layered nozzle fluid ejection device according to claim 15, wherein the first nozzle layer is disposed between the second nozzle layer and the ejection chamber, and the first nozzle layer orifice dimension is greater than the second nozzle layer orifice diameter.

18. The multi-layered nozzle fluid ejection device according to claim 15, wherein the second nozzle layer includes a tapered cross-section, and the second nozzle layer orifice diameter is disposed at an outermost surface of the second nozzle layer relative to the ejection chamber.

19. The multi-layered nozzle fluid ejection device according to claim 15, wherein the second nozzle layer includes a tapered cross-section, and the second nozzle layer orifice diameter is disposed at an innermost surface of the second nozzle layer relative to the ejection chamber.

* * * * *